US006082589A

United States Patent [19]

Ash et al.

[11] Patent Number: 6,082,589

[45] **Date of Patent: *Jul. 4, 2000**

[54] SLUSH BEVERAGE DISPENSING SYSTEM

[76] Inventors: Fred L. Ash; William O. Ash, Jr., both of 5300 Glenmont Dr., Houston, Tex. 77081

[ * ] Notice: This patent is subject to a terminal disclaimer.

[21] Appl. No.: 09/107,946

[22] Filed: Jun. 30, 1998

Related U.S. Application Data

[63] Continuation-in-part of application No. 08/599,945, Feb. 14, 1996, Pat. No. 5,772,075.

[51] Int. Cl.[7] ..... B67D 5/62

[52] U.S. Cl. ..... 222/146.6; 222/175; 222/190; 222/226; 222/399

[58] Field of Search ..... 222/1, 146.6, 175, 222/190, 226, 399, 401

[56] References Cited

U.S. PATENT DOCUMENTS

| | | | |
|---|---|---|---|
| 4,470,522 | 9/1984 | Lents et al. | 222/146.6 |
| 5,385,275 | 1/1995 | Billet | 222/175 |
| 5,529,220 | 6/1996 | Credle, Jr. et al. | 222/175 |
| 5,588,558 | 12/1996 | Cox et al. | 222/146.6 |
| 5,617,736 | 4/1997 | Ito et al. | 222/146.6 |
| 5,772,075 | 6/1998 | Ash, Jr. et al. | 222/146.6 |
| 5,848,734 | 12/1998 | Melk | 222/175 |
| 5,901,884 | 5/1999 | Goulet et al. | 222/146.6 |

*Primary Examiner*—Joseph A. Kaufman
*Attorney, Agent, or Firm*—Kenneth A. Roddy

[57] ABSTRACT

A semi-frozen slush beverage is contained in a thermally insulated vessel which is removably supported on a base unit containing a gas pressurizing mechanism and a motor connected to an electrical source. The gas pressurizing mechanism is controlled by a pressure sensor to maintain pressure on the beverage inside the vessel and an agitator contained within the vessel is releasably connected to the motor shaft when the vessel is supported on the base unit and is operated to swirl the beverage to prevent the semi-frozen slush beverage from separating. A slush delivery valve on the vessel side wall has an outlet end to which a dispensing nozzle or a flexible insulated hose having a dispensing nozzle at its outer end may be releasably connected for dispensing the beverage. The power source may be a battery disposed in the base unit and the base unit may be provided with a battery recharging receptical and associated circuitry. The base unit may also be provided with circuitry and a switch for bypassing the pressurizing mechanism to allow gravity dispensing. In a stand-alone embodiment the base unit and vessel may be supported on a counter top or in a cabinet and, in a portable embodiment, the base unit and vessel are contained within a backpack worn by a vendor.

24 Claims, 6 Drawing Sheets

10
11
12
13
14
15
16
17
18
19
20
21
22
25
26
27
28
29
30
32
33
34
40
43
45
47
48
50
50
51
53
54
55
60
67
68
4
4
5
5

SLUSH BEVERAGE DISPENSING SYSTEM

CROSS-REFERENCE TO RELATED APPLICATION

This application is a continuation-in-part of U.S. patent application Ser. No. 08/599,945 filed Feb. 14, 1996, now U.S. Pat. No. 5,772,075.

BACKGROUND OF THE INVENTION

1. Field of the Invention

This invention relates generally to beverage dispensers for dispensing semi-frozen slush beverages, and more particularly to a slush beverage dispensing system having a base unit housing a motor connected with an electrical power source and a gas pressurizing member, and an insulated slush dispensing vessel removably supported on the base unit with an interior rotating agitator releasably connected to the motor when the vessel is supported on the base, and such a system capable of use as a stand-alone system or as a self-contained portable system housed in a backpack supported on the back of a vendor.

2. Brief Description of the Prior Art

"Slush" beverages, as the term is used herein, are defined as a thick semi-frozen beverage having a semi-solid ice consistancy, similar to partly melted snow, and consist of a mixture of flavored liquid or syrup, frozen crystals of the liquid or syrup, and other materials. Examples of "slush" beverages are frozen cocktails, such as a "frozen margarita" or "daquiri", and flavored soft drinks or carbonated drinks, such as the popular slush beverage known commercially as an "icee" or a "slurpy" which are available at convenience stores and fast food chains. The slush type beverages are normally dispensed from a special machine at a fixed location and thus are not widely vended at sports stadiums, and other locations remote from the special machine required to make the beverages.

Because of the viscosity of the frozen semi-solid ice crystals, prior art and conventional "liquid" beverage dispensors are not suitable for storing and dispensing a "slush" beverage, because there is no provision for agitating the slush to maintain its consistancy and the small orifices of the conventional "liquid" dispensers" will freeze up or become plugged with the frozen ice crystals. Also, conventional metal vessels or containers, if uninsulated, may develop a thin layer of ice on their exterior due to the temperature of the semi-frozen slush.

Portable liquid beverage dispensers adapted to be transported on the back of a vendor by use of a body harness are also known in the art, as disclosed by way of example, in U.S. Pat. No. 2,684,787 to Charpiat and U.S. Pat. No. 2,808,965 to Grafia et al. Such portable dispensers include a tank made of rigid material enclosing a liquid storing chamber from which the beverage is dispensed and into which the beverage is charged through a reloading valve connected to the bottom of the tank. The beverage is accordingly dispensed under a gravitational pressure head. To assist in dispensing of the beverage, particularly when the liquid within the tank becomes depleted, the tank chamber may be internally pressurized with air by means of a pump as disclosed, for example, in U.S. Pat. No. 3,147,889 to Dolgin.

Motsenbocker, U.S. Pat. No. 4,420,097 discloses a portable liquid dispenser having an insulated carring case which contains a first flexible container and a second flexible container positioned therein. A freezable liquid is contained ir the second container and the liquid to be dispensed is contained in the first container in contact with the surface of the container with the frozen liquid to cool the liquid to be dispensed. The liquid is dispensed under gravitational pressure.

Boxer et al, U.S. Pat. No. 4,526,298 discloses a flexible water bag or pouch which may be insulated that is carried on shoulder straps similar to a back pack. The liquid is dispensed by a squeeze type dispensing nozzle.

Ash, U.S. Pat. Nos. 4,896,402 and 5,199,609, disclose a rigid dispenser tank with an outer insulated jacket and an interior flexible bladder which is pressurized to maintain the liquid under pressure.

Sims, U.S. Pat. No. 3,662,929 discloses a non-insulated rigid container with interior flexible bladder connected to a source of fluid pressure. A fluid substance to be dispensed is stored in the rigid container and the flexible bladder is inflated to discharge the fluid substance under pressure.

Uhlig, U.S. Pat. No. 4,098,434 discloses a non-insulated fluid product dispenser having first container and a second flexible container positioned inside the first container. Fluid to be dispensed is contained in one of the containers and fluid under pressure is introduced into the other container to urge the product fluid through a dispensing nozzle or opening.

Cornelius, U.S. Pat. No. 2,513,455 discloses a non-insulated rigid dispenser tank with an interior flexible bladder connected to a gas container. Fluid to be dispensed is stored in the rigid dispenser tank. The gas fed to the bladder condenses at the pressure and temperature at which the fluid in the container is to be discharged.

Shy, U.S. Pat. No. 4,300,705 discloses a compressed vacuum insulated bottle which operates by siphonage and compression of an elastic pouch in the top of the bottle stopper to siphon boiling water into the elastic pouch and then to drain off the boiling water by compression.

Billet, U.S. Pat. No. 4,921,143 discloses a portable beverage dispenser carried on the back of a vendor and has an insulated tank for containing a beverage, a hand pump for manually pressurizing the contents, and a thermally insulated dispensing hose.

Billet, U.S. Pat. No. 5,385,275 discloses a portable beverage dispenser carried on the back of a vendor and has an insulated dispensing chamber for containing a carbonated beverage, a thermally insulated dispensing hose, and a tank holding liquid gas for pressurizing the dispensing chamber.

Credle, Jr., et al, U.S. Pat. No. 5,529,220 discloses a portable beverage dispenser system a plurality of bottles of premix beverage connected in series with a $CO_2$ cylinder carried in an insulated pack supported on the shoulder of a vendor.

Cox et al, U.S. Pat. No. 5,588,558 discloses a stationary liquid beverage dispenser for displaying and dispensing liquid beverages which includes a liquid containing dispensing chamber, a pump for transferring amounts of the beverage from a storage chamber to the dispensing chamber, and a optical level sensor for activating the pump when the liquid level falls below a predetermined level.

The above described "liquid" beverage dispensers are not suitable for use for storing and dispensing a "slush" beverage, because there is no provision for agitating the slush to maintain its consistancy and the small orifices and check valves in the dispensing system of the conventional "liquid" dispensers" will freeze up or become plugged with the frozen ice crystals. Also, the conventional uninsulated metal vessels or containers may develop a thin layer of ice on their exterior due to the temperature of the semi-frozen slush. Those systems using a pressurized tank containing a supply of gas for pressuring the beverage container are heavy to transport and require frequent replacement of the pressurized gas tank.

The present invention is distinguished over the prior art in general, and these patents in particular, by a slush beverage dispensing system wherein a semi-frozen slush beverage is contained in a thermally insulated vessel which is removably supported on a base unit containing a gas pressurizing mechanism and a motor connected to an electrical source. The gas pressurizing mechanism is controlled by a pressure sensor to maintain pressure on the beverage inside the vessel and an agitator contained within the vessel is releasably connected to the motor shaft when the vessel is supported on the base unit and is operated to swirl the beverage to prevent the semi-frozen slush beverage from separating. A slush delivery valve on the vessel side wall has an outlet end to which a dispensing nozzle or a flexible insulated hose having a dispensing nozzle at its outer end may be releasably connected for dispensing the beverage. The power source may be a battery disposed in the base unit and the base unit may be provided with a battery recharging receptical and associated circuitry. The base unit may also be provided with circuitry and a switch for bypassing the pressurizing mechanism to allow gravity dispensing. In a stand-alone embodiment the base unit and vessel may be supported on a counter top or in a cabinet and, in a portable embodiment, the base unit and vessel are contained within a backpack worn by a vendor.

SUMMARY OF THE INVENTION

It is therefore an object of this invention to provide a beverage dispensing system which is suitable for containing and dispersing semi-frozen slush beverages.

It is another object of the present invention to provide a slush beverage dispensing system which is capable of use as a stationary beverage dispenser or a portable self-contained system carried in a backpack supported on the back of a vendor.

Another object of this invention to provide a slush beverage dispensing system which will allow slush beverages to be served at optimum temperatures, mixtures, and carbonation levels and in a sanitary manner.

Another object of this invention to provide a self-contained slush beverage dispensing system having an agitator in a pressurized vessel wherein the agitator motor and pressurizing mechanism are powered by a battery.

A further object of this invention to provide a slush beverage dispensing system having a base unit containing a motor, a gas pressurizing mechanism, and a power supply, and a beverage containing vessel having an internal agitator which is releasably connected to the motor when the vessel is supported on the base unit.

A still further object of this invention is to provide a portable beverage dispensing system which is aesthetically pleasing, simple in construction, economical to manufacture, and rugged and reliable in operation.

Other objects of the invention will become apparent from time to time throughout the specification and claims as hereinafter related.

The above noted objects and other objects of the invention are accomplished by a slush beverage dispensing system wherein a semi-frozen slush beverage is contained in a thermally insulated vessel which is removably supported on a base unit containing a gas pressurizing mechanism and a motor connected to an electrical source. The gas pressurizing mechanism is controlled by a pressure sensor to maintain pressure on the beverage inside the vessel and an agitator contained within the vessel is releasably connected to the motor shaft when the vessel is supported on the base unit and is operated to swirl the beverage to prevent the semi-frozen slush beverage from separating. A slush delivery valve on the vessel side wall has an outlet end to which a dispensing nozzle or a flexible insulated hose having a dispensing nozzle at its outer end may be releasably connected for dispensing the beverage. The power source may be a battery disposed in the base unit and the base unit may be provided with a battery recharging receptical and associated circuitry. The base unit may also be provided with circuitry and a switch for bypassing the pressurizing mechanism to allow gravity dispensing. In a stand-alone embodiment the base unit and vessel may be supported on a counter top or in a cabinet and, in a portable embodiment, the base unit and vessel are contained within a backpack worn by a vendor.

DESCRIPTION OF THE PREFERRED EMBODIMENT

Figure 1:
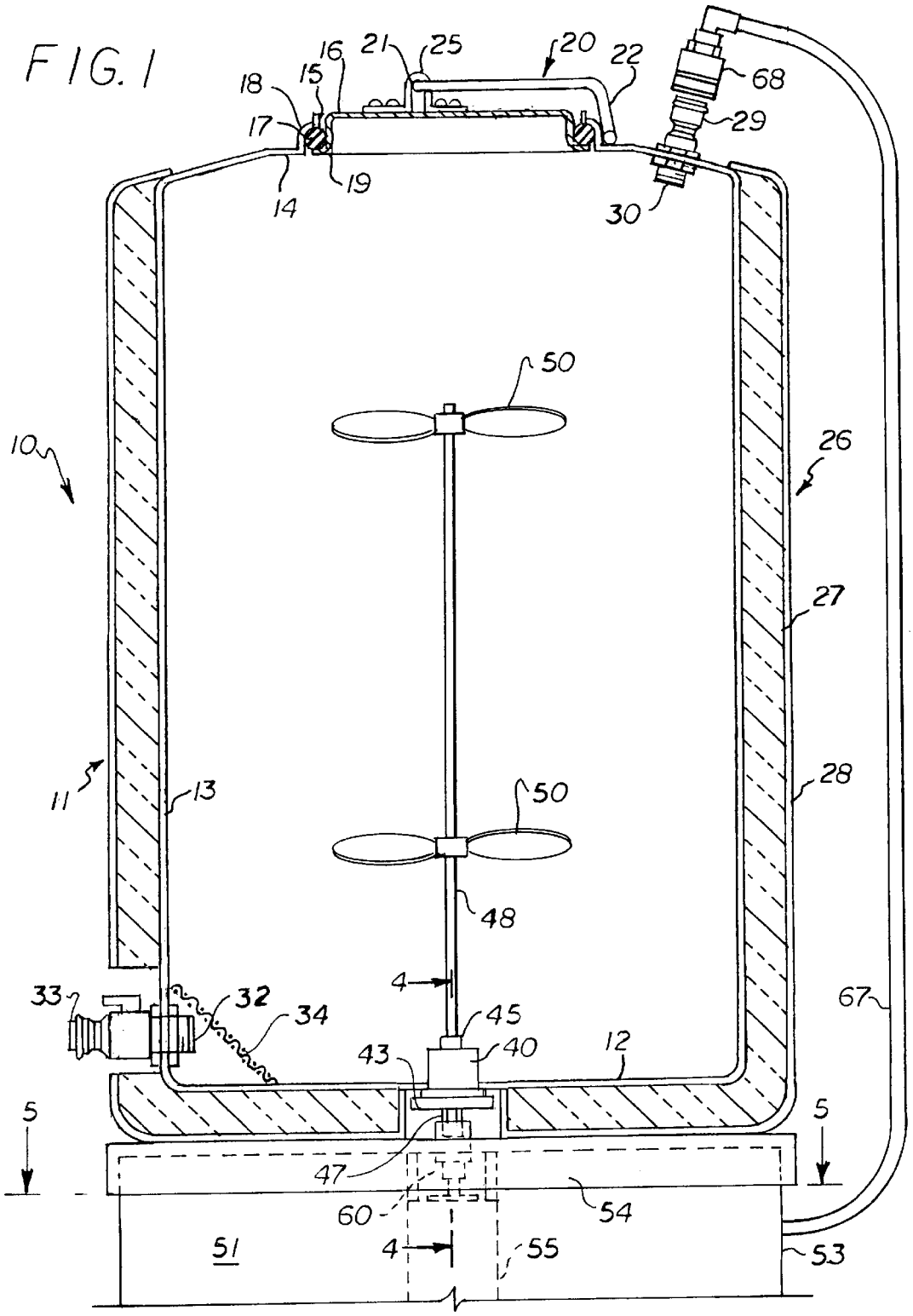
FIG. 1 is a longitudinal cross section through the slush beverage dispensing vessel supported on a base unit in accordance with the present invention.
Figure 3:
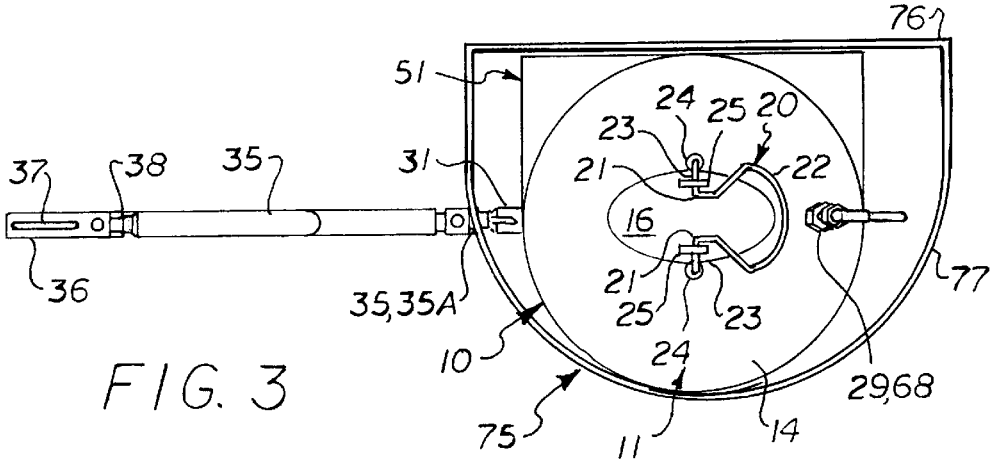
FIG. 3 is a top plan view of the back pack with the lid open and showing the slush beverage dispensing apparatus contained therein.
Figure 2:
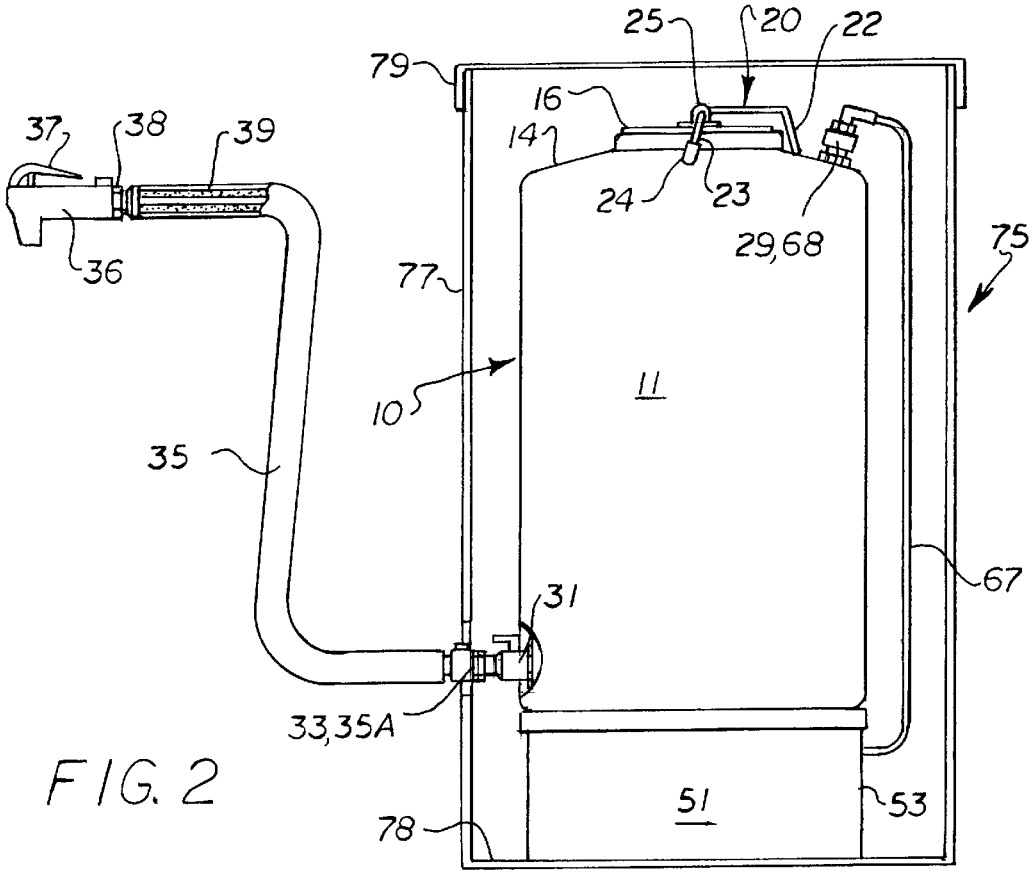
FIG. 2 is a longitudinal cross section through a backpack having the slush beverage dispensing apparatus in accordance with the present invention contained therein.

Referring to the drawings by numerals of reference, there is shown in FIGS. 1, 2, and 3, a portable slush beverage dispensing system 10 which is carried in a backpack 75. The present dispensing system is particulary adapted for dispensing a thick semi-frozen "slush" beverage having a semi-solid ice consistancy, similar to partly melted snow, such as flavored soft drinks or carbonated drinks known commercially as an "icee" or a "slurpy", or frozen cocktails, such as a "frozen margarita" or "daquiri".

As shown in FIG. 1, the slush beverage dispensing system includes a slush beverage container or vessel 11 made of stainless steel, aluminum, or other suitable material. The vessel 11 has a bottom wall 12 , a side wall 13, and a top wall 14. A generally oval-shaped access opening 15 is formed in the top wall 14. The access opening 15 is sealingly closed by an oval-shaped lid closure member 16 on which an annular sealing ring 17 is carried. The opening 15 has a surrounding flange 18 semi-circular in cross section, and the lid closure 16 has an opposite opposed annular semi-circular flange 19. The flanges 18 and 19 cooperate with the sealing ring 17 to form a fluid tight seal at the top of the vessel 11.

As best seen in FIGS. 1, 2, and 3, the lid closure 16 has a releasable latch 20 made of bent rod forming axially aligned pivot shaft portions 21 interconnected by a generally U-shaped portion 22 extending at right angles therefrom. The end of the U-shaped portion 22 is curved downwardly for engagement with the top wall 14 of the vessel 11 at the rim of the flanged portion 18 so as to angularly position a pair of leg portions 23 depending from the ends of the shaft portions 21 into frictional engagement with the top of the vessel in the latched condition. The ends of the leg portions 23 are provided with resilient end caps 24. The shaft portions 21 are pivotally restrained on top of the lid 16 by a pair of pivot brackets 25. To release the lid 16 from its sealed condition, the U-shaped portion 22 of the latch 20 is pivoted upwardly to angularly displace the leg portions 23 out of engagement with the top 14 of the vessel 11. The lid 16 may then be removed from the access opening 15. Due to the viscosity of the frozen semi-solid ice crystals, the vessel 11 is preferrably filled with the thick semi-frozen "slush" beverage by pouring it through the opening 15.

As seen in FIG. 1, the exterior of the vessel 11 is substantially surrounded by a thermally insulating and shock absorbing jacket 26. The jacket 26 is formed of a dense layer 27 of thermally insulating and shock absorbent elastomeric material such as foam plastic or foam rubber in contact with the tank exterior and, preferrably, has a flexible outer layer or skin 28. The jacket 26 insulates the vessel 11 and prevents the formation of a thin layer of ice on its exterior due to the temperature of the semi-frozen slush beverage contained therein, and also serves a shock absorber or cushion.

A quick-release type gas fill and recharging check valve 29 is connected to the top wall 14 of the vessel 11 and has a passageway 30 extending through the top wall and into the top portion of the vessel. A slush dispensing valve 31 is connected to the side wall 13 of the vessel and has a passageway 32 extending through the side wall near the bottom wall 12. In the preferred embodiment, the slush dispensing valve is a ball valve having a quick-release connection 33 at its outlet end. A foraminous strainer or screen 34 covers the inlet end of the valve 31 to prevent passage of large ice crystals.

As seen in FIGS. 2 and 3, a dispensing hose 35 may be connected to the slush dispensing valve 31 by a quick-release coupling 35A at one end. A manually operable slush dispensing nozzel 36 having a trigger mechanism 37 is connected to the distal end of the hose 35 by a quick-release coupling 38. The dispensing hose 35 has an outer covering 39 of flexible insulating material. The slush dispensing nozzle 36 may be disconnected from the hose 35 and connected directly to the outlet end 33 of the dispensing valve 31 when the hose is not used.

The orifices and passageways in the dispensing valve 31, the dispensing hose 35 and the dispensing nozzle 36 are sized to allow passage of the slush beverage and to prevent them from becoming plugged with frozen ice crystals.

Figure 4:
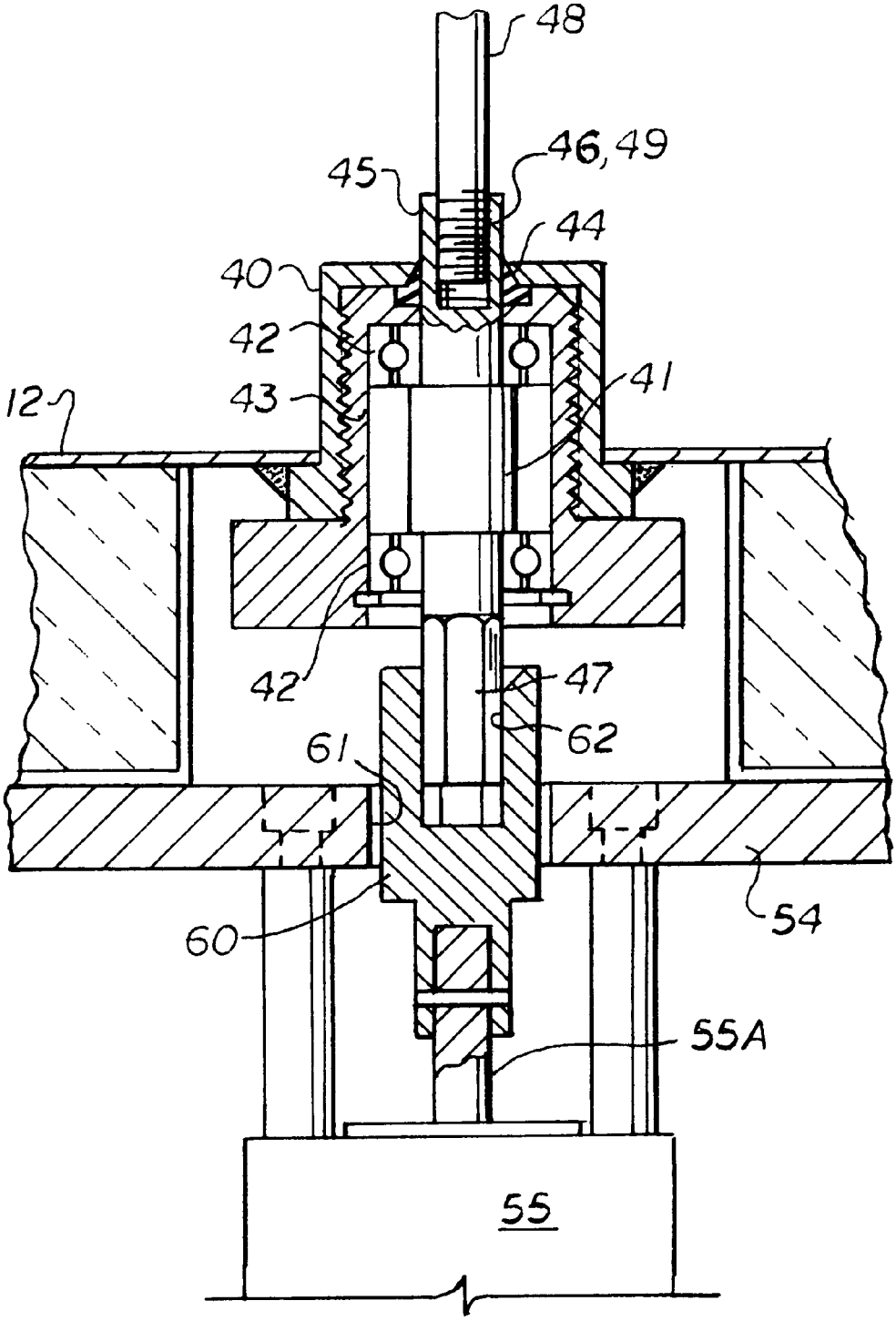
FIG. 4 is a longitudinal cross section taken along line 4—4 of FIG. 1 showing the details of the spindle and shaft connection between the motor in the base unit and agitator shaft in the vessel.

As shown in FIGS. 1 and 4, a spindle housing 40 is secured in the bottom wall 12 of the vessel 11. A central spindle 41 is rotatably mounted in bearings 42 in a gland 43 installed in the housing 40 and its upper end is surrounded by a sealing element 44 to allow rotary motion of the spindle in a sealed relation. The upper end 45 of the spindle 41 extends upwardly through the spindle housing 40 and is provided with box threads 46. The lower end 47 of the spindle 41 extends downwardly from the gland 43 and is provided with a polygonal or hexagonal cross section or with exterior splines on its exterior.

An elongate shaft 48 having pin threads 49 at its bottom end is threadly engaged in the top end of the spindle 41 and extends upwardly into the interior of the of the vessel 11 to rotate with the spindle. One or more agitator blades 50 are secured on the shaft 28 to swirl the slush beverage within the vessel and to prevent the semi-frozen slush beverage from separating.

Figure 5:
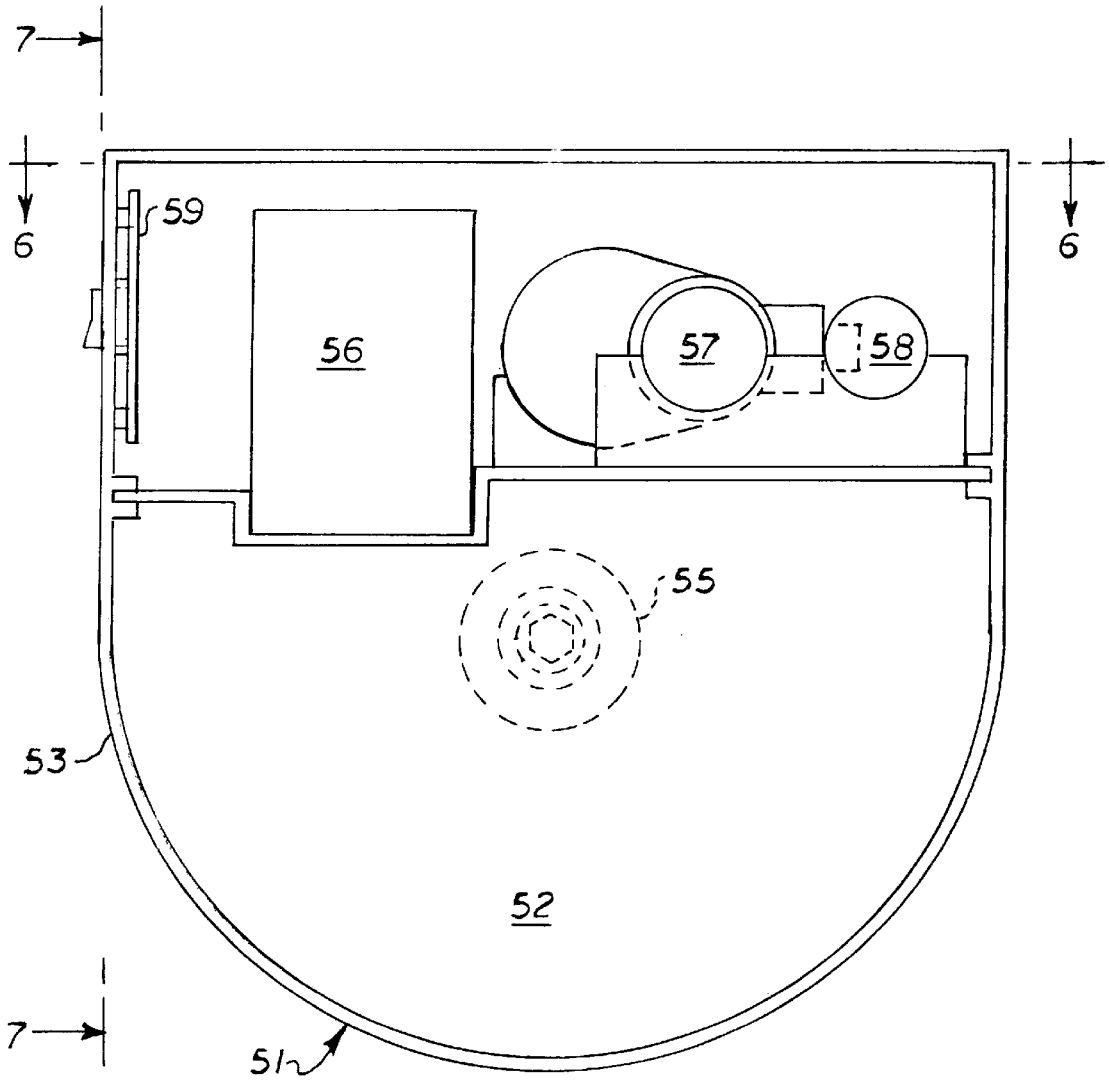
FIG. 5 is a top plan view of the base unit taken along line 5—5 of FIG. 1.
Figure 7:
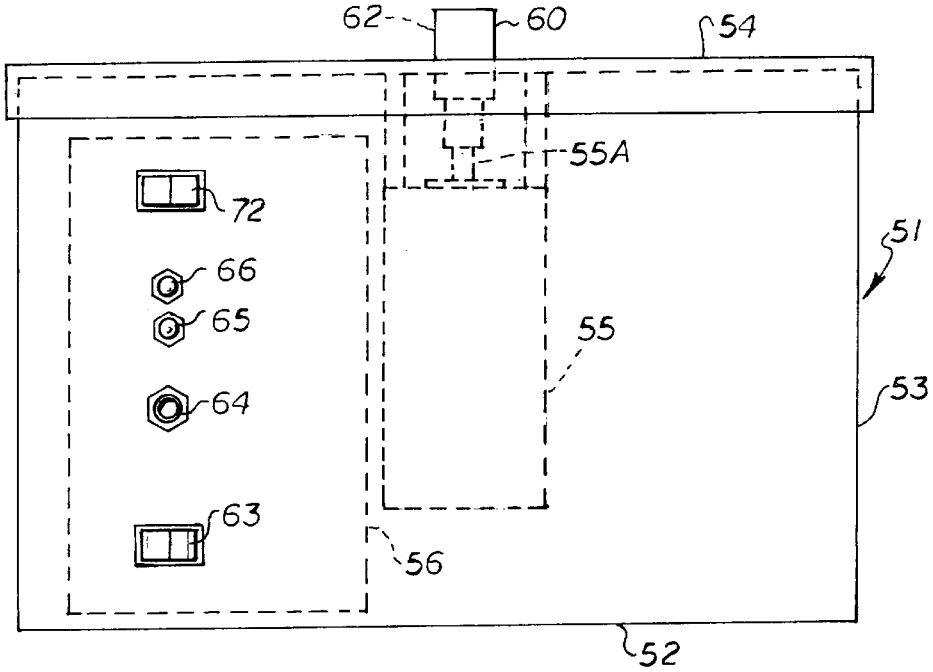
FIG. 7 is a side elevation of the base unit taken along line 7—7 of FIG. 5.
Figure 6:
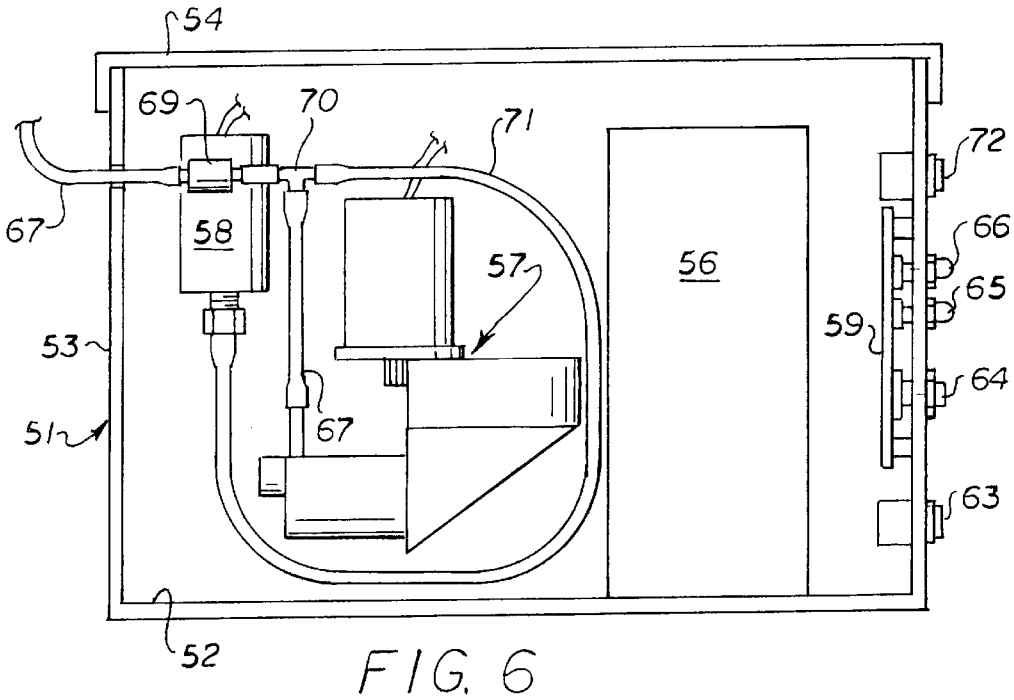
FIG. 6 is a cross section through the base unit taken along line 6—6 of FIG. 5 showing the components contained therein.
Figure 8:
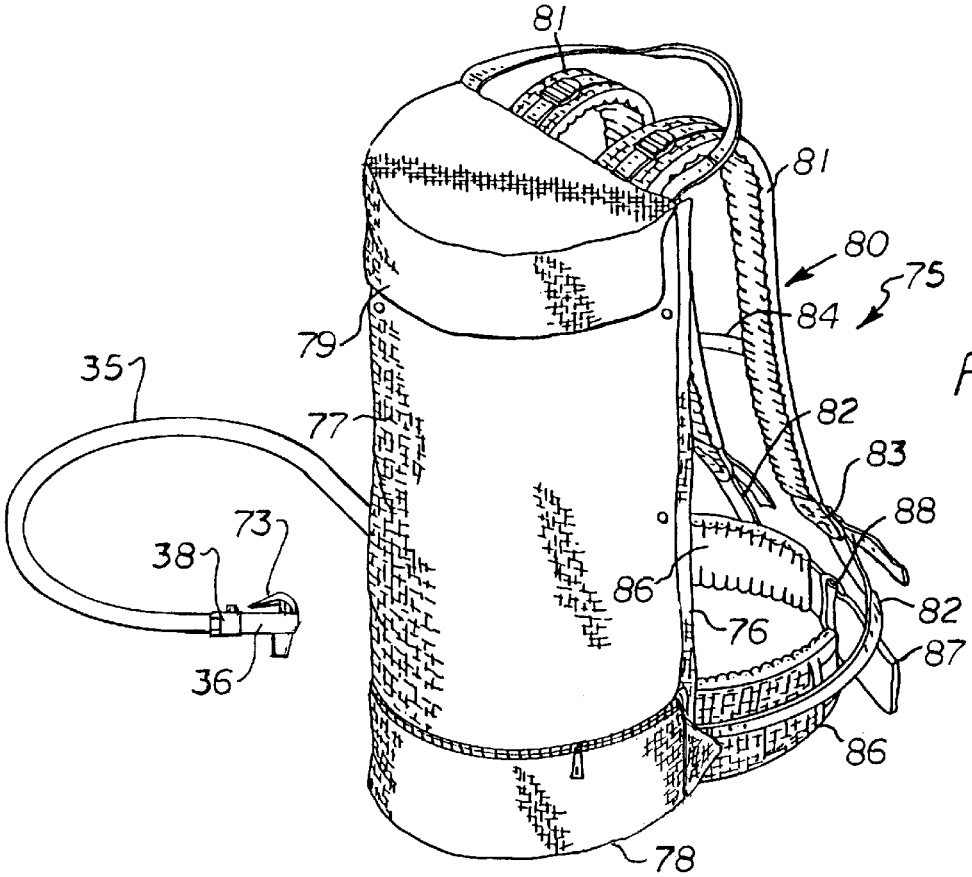
FIG. 8 is an isometric view of the backpack having the slush beverage dispensing apparatus contained therein.
Figure 9:
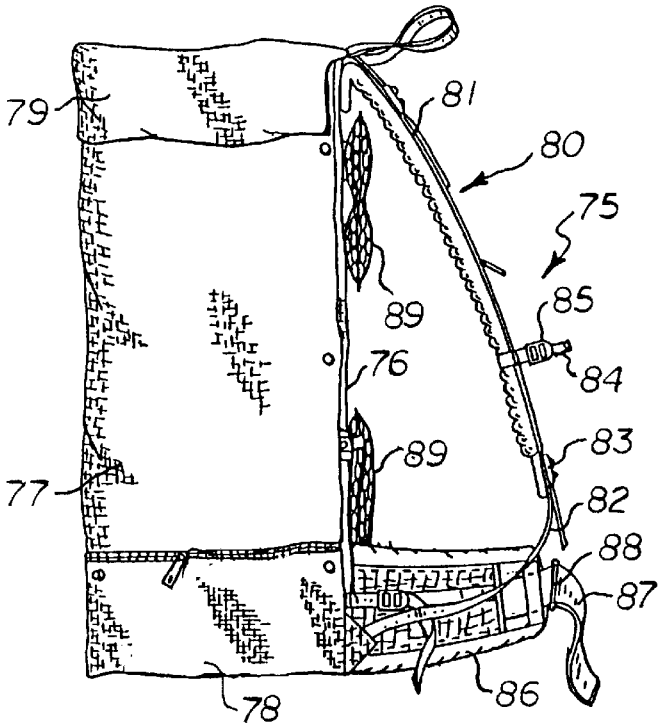
FIG. 9 is a side elevation of the backpack.

When in use, the bottom of the vessel 11 is removably supported on a base unit 51. Referring additionally to FIGS. 5, 6, and 7, the base unit 51 has a bottom wall 52, a side wall 53, and a removable lid 54. An electric motor 55, a battery 56, an electric air pump 57, a pressure sensor 58, and a circuit board 59 containing a microprocessor and associated control circuitry, are mounted within the base unit 51.

As best seen in FIGS. 1, 4, and 7, the motor 55 is secured to the underside of the lid 54. An adapter 60 secured to the shaft 55A of the electric motor 55 extends upwardly through an opening 61 in the lid 54 and has an upward facing female socket 62 which is configured to slidably receive and releasably engage the lower end 47 of the spindle 41 such that the spindle, the shaft 48 and agitator blades 50 are rotated by the motor.

In a preferred embodiment, the electric motor 55 is an AC/DC motor connected to a rechargeable battery 56 through an on-off switch 63 disposed on the side wall 53 of the base unit 51 (FIGS. 6 and 7). The battery 56 is also connected with a recharging plug 64 on the side wall of the base unit 51 and through a recharging circuit on the circuit board 59 to allow connection to conventional recharging apparatus for recharging the battery when necessary. A red LED 65 and a green LED 66 are mounted on the side wall 53 of the base unit 51 and connected to the recharging circuit on the circuit board to indicate when the battery is in a low condition and a charged condition, respectively.

The electric motor 55 may also be connected through a transformer/rectifier bypass circuit on the circuit board 59 that bypasses the battery 56 for using a 120 v AC power supply. It should be understood that in some stationary installations, the motor 55 may be an AC motor connected directly to a 120 v AC wall plug through an electrical cord.

The electric air pump 57 is connected to the DC power circuit on the circuit board 59. One end of a flexible gas supply conduit 67 connected to the outlet of the air pump 57 extends through the side wall 53 of the base unit 51 and has a quick-release coupling 68 at its outer end which is releasably connected to the gas fill and recharging valve 29 at the top of the vessel 11 to pressurize the interior of the vessel. An air filter 69 may also be connected into the gas supply conduit 67 for filtering the air prior to its entry into the vessel.

The operation of the air pump 57 is controlled by the pressure sensor 58 which is connected into the gas supply conduit 67 by a tee connection 70 and conduit 71. The pressure sensor 58 has electical leads connected to the DC power circuit on the circuit board 59 powering the air pump 57 to activate and deactivate the air pump upon sensing a predeterimined pressure within the vessel 11 to maintain the interior of the vessel and its contents at a predetermined pressure.

It should be understood that, alternatively, a hand pump or a pressurized supply tank may be used in place of the electric air pump to pressurize the interior of the vessel Optionally, a pump on-off switch 72 may be provided on the side wall 53 of the base unit 51 and connected with the circuit supplying power to the air pump 57 to disable the air pump and allow gravity feed of the contents of the vessel. In a gravity feed operation, the switch 72 is turned to the off position, and the lid 16 is opened or removed to allow air to enter through the access opening 15. Thus, when the valve 31 and nozzle 36 are opened the vessel contents will flow out due to the force of gravity.

The particular electrical circuitry for operating and controlling the operation of the electrical components described above are conventional and readily understood by those skilled in the art and are therefore not shown in detail.

The slush beverage dispensing system 10 may be used as a stand-alone system in bars and resturants wherein the base unit 51 is supported on a countertop and the vessel 11 is supported on the base unit as shown in FIG. 1. In these types of installations, several pre-filled vessels may be stored and when one becomes empty it is removed from the base unit and replaced by a filled vessel. Also in these types of installations, the dispensing hose 35 may not be required, in which case the dispensing nozzle 36 is attached directed to the dispensing valve 31 by the quick-release conection.

It should be understood that the base unit 51 and the vessel 11 may be enclosed in a cabinet which is provided with an opening through which the dispensing nozzle 36 would extend and an access door or opening for installing and removing the vessels as needed.

As shown in FIGS. 2, 3, 8 and 9, the slush beverage dispensing vessel 11 and the base unit 51 including the components described above may also be carried in a backpack 75 to allow the slush beverage system to be transported and the beverage dispensed by vendors. In a preferred embodiment, the backpack 75 has a back wall 76, a side wall 77, a bottom wall 78 and a top closure 79 defining a central interior compartment. A shoulder harness 80 is secured to the backpack 75 and has a pair of padded shoulder straps 81, each of which are connected to the backpack by an adjustment strap 82 and adjustment buckle 83 and are interconnected by a transverse chest strap 84 and adjustment buckle 85 to permit proper adjustment of the shoulder straps about the shoulders and chest of a vendor. The backpack 75 is also provided with a pair of padded waist belt sections 86 interconnected by an adjustment strap 87 and adjustment buckle 88 for encircling the waist of the vendor. One or more back pads 89 may also be secured to the back wall 76 of the backpack 75 to provide added comfort to the wearer.

The base unit 51 is placed in the bottom of the central interior compartment of the backpack 75 and the vessel 11 is placed down onto the base unit 51 making sure that the bottom end 47 of the spindle 41 is received in the upwardly facing socket 62 of the adapter 60 secured to the shaft of the motor 55. It should be understood that the backpack 75 may be provided with an opening (not shown) in its sidewall 77 to allow observation of the LEDs and access to the switches on the side wall of the base unit 51. The side wall 77 of the back pack 75 is also provided with an opening through which the dispensing hose 35 extends. When not in use, the dispensing hose 35 may be stored inside the back pack.

While this invention has been described fully and completely with special emphasis upon a preferred embodiment, it should be understood that within the scope of the appended claims the invention may be practiced otherwise than as specifically described herein.

What is claimed is:

1. A slush beverage dispensing system comprising:

a base unit having a top wall, a bottom wall and a side wall;

motor means disposed in said base unit connected with an electrical power source and having a rotatable shaft disposed adjacent said base unit top wall;

a vessel removably supported on said base unit top wall and having a side wall and a bottom wall defining an interior chamber for containing a slush beverage, an access opening at one end thereof, and a releasable closure lid removably mounted on said vessel opening, said vessel being thermally insulated to maintain said slush beverage in a low temperature condition;

a slush delivery valve on said vessel side wall having a first end in communication with said interior chamber and a second end exterior of said chamber for dispensing said slush beverage contained within said vessel; and agitator means including an agitator shaft with a blade thereon rotatably disposed in said chamber to swirl and agitate said slush beverage and shaft connection means at a lower end thereof extending rotatably through said vessel bottom wall in sealed relation for releasable connection to said motor shaft for rotating said agitator shaft and blade when said vessel is supported on said base unit.

2. The slush beverage dispensing system according to claim 1 further comprising gas filling valve means on said vessel with a passageway in communication with said interior chamber and adapted to be connected with gas pressurizing means; and gas pressurizing means disposed in said base unit and operatively connected with said gas filling valve means to effect pressurization of said slush beverage contained within said chamber.

3. The slush beverage dispensing system according to claim 2 further comprising pressure sensing means operatively connected in fluid communication with said interior chamber and with said gas pressurizing means for sensing pressure in said interior chamber and controlling the operation of said gas pressurizing means to maintain a predetermined pressure in said interior chamber.

4. The slush beverage dispensing system according to claim 3 in which said gas pressurizing means comprises an electric air pump operatively connected with said power source and said pressure sensing means for effecting pressurization of said slush beverage contained within said chamber.

5. The slush beverage dispensing system according to claim 4 further comprising air filter means connected in fluid communication between said interior chamber and said gas pressurizing means for filtering air entering said interior chamber.

6. The slush beverage dispensing system according to claim 4 further comprising air pump switch means on said base unit and associated bypass circuitry therein connected with said air pump and said power source for selectively deactivating said air pump to allow gravity dispensing of said slush beverage when said closure lid is unlocked and removed from said vessel opening.

7. The slush beverage dispensing system according to claim 1 further comprising:

a battery disposed in said base unit and connected with said motor means;

motor switch means on said base unit connected with said battery and said motor means for selectively controlling the operation of said motor means; and visual indicator means on said base unit connected with said battery for indicating the condition of said battery.

8. The slush beverage dispensing system according to claim 7 further comprising a battery recharging receptical on said base unit and associated circuitry in said base unit connected with said battery for releasably connecting battery charging apparatus to recharge said battery.

9. The slush beverage dispensing system according to claim 1 wherein said slush delivery valve second end has a quick-release connection for releasable connection to either of a dispensing hose and a slush dispensing nozzle.

10. The slush beverage dispensing system according to claim 9 wherein said dispensing hose comprises a flexible dispensing hose having a thermally insulated outer covering and a mating quick-release connection at one end for connection to said slush delivery valve second end quick-release connection and a manually operable slush dispensing nozzle at an opposite end for dispensing said pressurized slush beverage from said chamber.

11. The slush beverage dispensing system according to claim 9 wherein said slush dispensing nozzle comprises a manually operable slush dispensing nozzle having a mating quick-release connection at one end for connection to said slush delivery valve second end quick-release connection for dispensing said pressurized slush beverage from said chamber.

12. The slush beverage dispensing system according to claim 1 further comprising a flexible thermally insulating and cushioning jacket closely surrounding the exterior of said side wall and said bottom wall of said vessel.

13. The slush beverage dispensing system according to claim 1 further comprising;

a backpack adapted to be worn by a vendor and having a central storage compartment, and said vessel and said base unit is removably received and carried within said central storage compartment.

14. A portable slush beverage dispensing system carried on the body of a person for dispensing slush beverages comprising:

a backpack adapted to be worn by a person and having a central storage compartment;

a base unit having a top wall, a bottom wall and a side wall removably received in a lower portion of said backpack;

motor means disposed in said base unit and having a rotatable shaft disposed adjacent said base unit top wall;

a battery disposed in said base unit and connected with said motor means;

motor switch means on said base unit connected with said battery and said motor means for selectively controlling the operation of said motor means;

a thermally insulated vessel having a side wall and a bottom wall defining an interior chamber, an access opening at one end thereof, and a releasable closure lid removably mounted on said vessel opening, said vessel removably received in an upper portion of said backpack with its bottom wall supported on said base unit top wall;

agitator means including an agitator shaft with a blade thereon rotatably disposed in said chamber to swirl and agitate said slush beverage and shaft connection means at a lower end thereof extending rotatably through said vessel bottom wall in sealed relation for releasable connection to said motor shaft for rotating said agitator shaft and blade when said vessel is supported on said base unit;

a slush delivery valve on said vessel side wall having a first end in communication with said interior chamber and a second end exterior of said chamber for dispensing said slush beverage contained within said vessel; and a flexible dispensing hose having a thermally insulated outer covering and a connection at one end for releasable connection to said slush delivery valve second end and a manually operable slush dispensing nozzle at an opposite end for dispensing said slush beverage from said chamber.

15. The slush beverage dispensing system according to claim 14 further comprising gas filling valve means on said vessel with a passageway in communication with said interior chamber and adapted to be connected with gas pressurizing means; and gas pressurizing means disposed in said base unit and operatively connected with said gas filling valve means to effect pressurization of said slush beverage contained within said chamber.

16. The slush beverage dispensing system according to claim 15 further comprising pressure sensing means operatively connected in fluid communication with said interior chamber and with said gas pressurizing means for sensing pressure in said interior chamber and controlling the operation of said gas pressurizing means to maintain a predetermined pressure in said interior chamber.

17. The slush beverage dispensing system according to claim 16 in which said gas pressurizing means comprises an electric air pump operatively connected with said power source and said pressure sensing means for effecting pressurization of said slush beverage contained within said chamber.

18. The slush beverage dispensing system according to claim 17 further comprising air filter means connected in fluid communication between said interior chamber and said gas pressurizing means for filtering air entering said interior chamber.

19. The slush beverage dispensing system according to claim 17 further comprising air pump switch means on said base unit and associated bypass circuitry therein connected with said air pump and said power source for selectively deactivating said air pump to allow gravity dispensing of said slush beverage when said closure lid is unlocked and removed from said vessel opening.

20. The slush beverage dispensing system according to claim 14 further comprising a battery recharging receptical on said base unit and associated circuitry in said base unit connected with said battery for releasably connecting battery charging apparatus to recharge said battery.

21. A portable slush beverage dispensing system carried on the body of a person for dispensing slush beverages comprising:

a backpack adapted to be worn by a person and having a central storage compartment;

a vessel having a side wall and a bottom wall defining an interior chamber, an access opening at one end thereof, and a releasable closure lid removably mounted on said access opening, said vessel removably received and supported in said backpack central storage compartment;

motor means adapted for releasable connection to said vessel and having a rotatable shaft connected therewith extending into said interior chamber with a blade thereon to swirl and agitate said slush beverage;

motor switch means connected between said motor means and a source of electrical power for controlling the operation of said motor means to selectively rotate said shaft and blade; and slush dispensing means having a first end connected in fluid communication with said interior chamber and a second end exterior of said chamber for dispensing said slush beverage contained within said interior chamber.

22. The portable slush beverage dispensing system according to claim 21 wherein;

said slush dispensing means comprises a flexible hose having a first end connected with said vessel, an interior in fluid communication with said interior chamber, and a manually operable nozzle at a second end exterior of said chamber for dispensing said slush beverage contained within said interior chamber.

23. The portable slush beverage dispensing system according to claim 21 wherein;

said slush dispensing means comprises a slush delivery valve on said vessel side wall having a first end in fluid communication with said interior chamber and a second end exterior of said chamber for dispensing said slush beverage contained within said interior chamber.

24. A portable slush beverage dispensing system adapted to be transported for dispensing slush beverages comprising:

a portable thermally insulated vessel having a side wall and a bottom wall defining an interior chamber for containing a slush beverage, an access opening at one end thereof, and a releasable closure lid removably mounted on said access opening;

motor means adapted for releasable connection to said vessel and having a rotatable shaft connected therewith extending into said interior chamber with a blade thereon to swirl and agitate said slush beverage;

motor switch means connected between said motor means and a source of electrical power for controlling the operation of said motor means to selectively rotate said shaft and blade; and a slush delivery valve on said vessel side wall having a first end in fluid communication with said interior chamber and a second end exterior of said chamber for dispensing said slush beverage contained within said vessel.

* * * * *